United States Patent [19]

Cifranic

[11] Patent Number: 4,569,447

[45] Date of Patent: Feb. 11, 1986

[54] BOOKRACK

[76] Inventor: Steve J. Cifranic, 14673 N. Gallatin Blvd., Brookpark, Ohio 44116

[21] Appl. No.: 405,416

[22] Filed: Aug. 5, 1982

[51] Int. Cl.[4] ..... A47B 65/00

[52] U.S. Cl. ..... 211/42; 211/181; 248/302; D19/26

[58] Field of Search ..... 211/42, 23, 24, 181; 248/DIG. 5, 300, 302, 311.2, 153, 175; D6/106, 184; D19/26

[56] References Cited

U.S. PATENT DOCUMENTS

| | | | |
|---|---|---|---|
| 748,438 | 12/1903 | Trahan | 248/300 |
| 819,248 | 5/1906 | Organ | 248/311.2 X |
| 1,467,082 | 9/1923 | Baldwin | 248/175 X |
| 1,682,060 | 8/1928 | Banks . | |
| 1,942,456 | 1/1934 | Stark . | |
| 2,185,299 | 1/1940 | Heraty | 248/302 X |
| 2,205,064 | 6/1940 | Irwin . | |
| 2,488,326 | 11/1949 | Pratt | 248/DIG. 5 X |
| 2,661,568 | 12/1953 | Stark . | |
| 2,818,318 | 12/1957 | Johnson | 248/DIG. 5 X |
| 2,872,046 | 2/1959 | Polay . | |
| 3,089,597 | 5/1963 | Kaplan | 248/DIG. 5 X |
| 3,318,453 | 5/1967 | Cavanaugh . | |
| 3,800,958 | 4/1974 | Dorn . | |
| 3,913,810 | 10/1975 | Shaw | 248/DIG. 5 |
| 3,918,588 | 11/1975 | Walser et al. | 211/181 X |
| 4,002,240 | 1/1977 | Dorn . | |

*Primary Examiner*—J. Franklin Foss
*Assistant Examiner*—David L. Talbott
*Attorney, Agent, or Firm*—D. Peter Hochberg

[57] ABSTRACT

A book holding device of open framework construction or flat sheet material formed to provide a base supporting at least some of the books, a back, and parallel, horizontal arms serving as bookends. Certain embodiments provide upturned stops formed at the laterally directed ends of the base below the arms to retain the lower edge portions of the books.

8 Claims, 6 Drawing Figures

BOOKRACK

BACKGROUND OF THE INVENTION

The present invention relates to book supporting devices such as bookracks, bookends, and similar articles adapted to retain and support a row of books in the generally upright position for display, storage, and the like.

Bookends and book holders of various forms are well-known. Some are laterally adjustable whereby they are adaptable to fit rows of books of different lengths. Bookends have been provided which are connected by springs urging them against the ends of a row of books. Separate bookends which may be used individually or in a predetermined assembly to prop up a book at a convenient angle for reading have been disclosed. Invertible supports are known which in one position retain a row of articles of a certain length and when inverted will support a row of articles of a different length. An invertible bookrack is known which retains a row of generally upright books in one position and supports a single book in an open position for reading when inverted.

SUMMARY OF THE INVENTION

The present invention comprises a bookrack of open framework construction made from elongated rigid elements providing a base for supporting at least part of a row of books, a vertically upright back, and attached, forwardly projecting arms adapted to retain the row of books at either end. Upright and laterally projecting elements, which may be integral and/or formed from a continuous length of material of uniform cross section, extend from the base to form the back and provide means at their outer ends which carry the forwardly projecting arms. The base may be formed to provide upright end stops at either end of the base for retaining the bottom edge portions of the row of books.

DESCRIPTION OF THE DRAWINGS

The objects of this invention and its many advantages will be readily understood from the description thereof and the accompanying drawings in which.

DESCRIPTION OF THE PREFERRED EMBODIMENTS

The following description of preferred embodiments of the invention refers to the above described drawings in which corresponding elements in the different figures of the drawings are identified by corresponding numerals or other graphic symbols.

Figure 1:
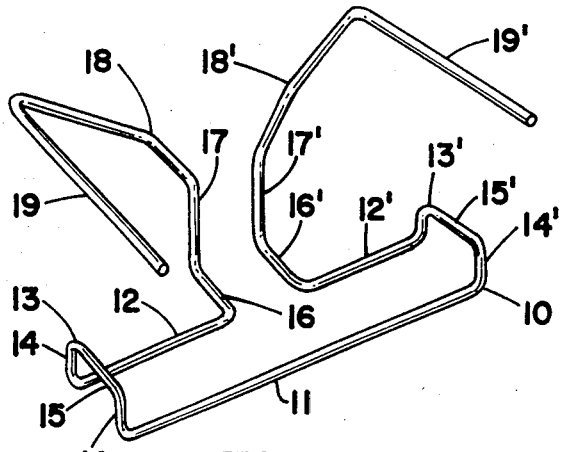
FIG. 1 is a perspective view of a first embodiment of the bookrack of this invention.
Figure 2:
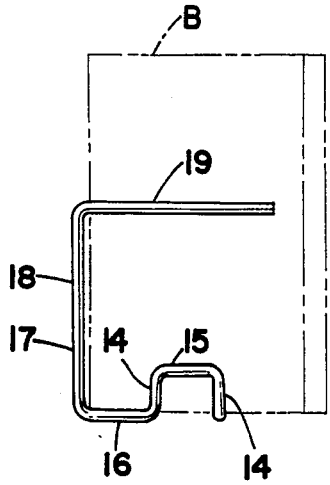
FIG. 2 is a side view of the bookrack as seen from the left side of FIG. 1.
Figure 3:
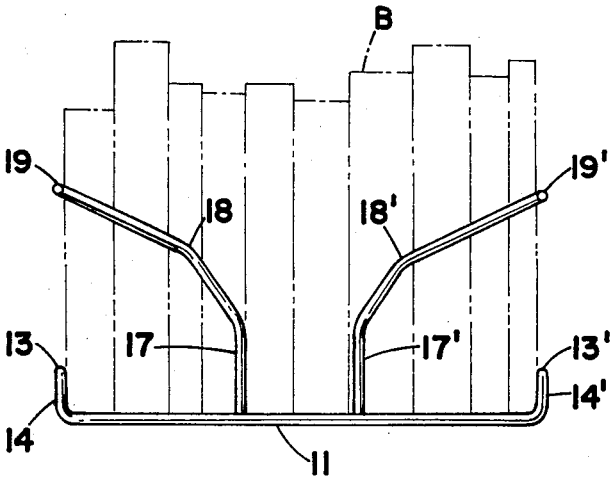
FIG. 3 is a front view of the bookrack of FIG. 1.

Referring now to FIGS. 1–3, the first embodiment is constructed of heavy wirelike elements of uniform cross section and may be formed from a single length of heavy wire stock. The open framework construction provides a base 10 comprising an elongated front bar 11 and a pair of axially aligned rear bars 12 and 12' disposed parallel with front bar 11. One end of the rear bar 12 is connected to one end of the front bar 11 by an inverted U-shaped connecting element 13 which comprises vertical portions 14 projecting upwardly from the ends of the front and rear bars and connected at their upper ends by a horizontal bar 15 which determines the spacing between said front and rear bars. The opposite end of the front bar 11 and one end of the rear bar 12' are similarly connected by an inverted U-shaped connecting element 13' having vertical portions 14' connected at their upper ends by a horizontal bar 15'.

The inner ends of the rear bars 12 and 12', opposite the connecting elements 13 and 13', are spaced apart. The inner end of the rear bar 12 terminates in a right angularly rearwardly bent spacer portion 16 disposed in the same plane as the base 10. The rearwardly directed end of the spacer portion 16 terminates in a vertical support 17 the upper end of which is connected to a laterally projecting angular member 18. The vertical support 17 and angular member 18 are disposed in a vertical plane which defines the back of the bookrack. The laterally projecting end of the angular member 18 is provided with a forwardly projecting arm 19 which is disposed directly over and in the same plane as the inverted U-shaped connecting element 13. Thus the arm 19 and the element 13 define one end of the bookrack. The opposite end of the bookrack is completed by a rearwardly directed spacer portion 16', a vertical support 17', a laterally projecting angular member 18' carrying a forwardly projecting arm 19' disposed substantially directly above the inverted U-shaped connecting element 13'.

FIGS. 2 and 3 illustrate the manner in which books B, shown in phantom line, are placed with their bottom edges between the upturned connecting elements 13 and 13', which serve as end stops for the bottom edges of a row of books, and their upper portions disposed between the parallel arms 19 and 19'. It will be readily seen that the bookrack effectively retains the books where shelved and provides a convenient, lightweight rack for retaining a number of books together while carrying them from one location to another.

Figure 4:
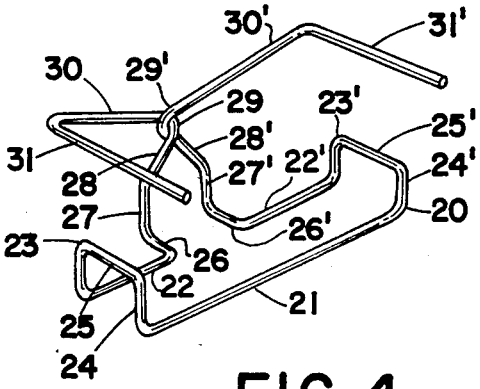
FIG. 4 is a perspective view of a second embodiment of the bookrack of this invention.

The embodiment of the invention as shown in FIG. 4 is also constructed of heavy wire elements. The base 20 is constructed in the same manner as the base 10 comprising a front bar 21, rear bars 22 and 22', and inverted U-shaped connecting elements 23 and 23'. Said inverted U-shaped elements comprise vertical portions 24 and 24' connected at their lower ends to the outer ends of the front bar 21 and rear bars 22 and 22' and connected across their upper ends by horizontal bars 25 and 25'. As in the first embodiment, the inverted U-shaped elements 23 and 23' provide end stops for the bottom edges of a row of books seated on the base 20. Spacer portions 26 and 26' project rearwardly from the inner ends of the rear bars 22 and 22' and terminate in vertical supports 27 and 27'.

Extending above the vertical supports 27 and 27' are laterally angled portions 28 and 28', respectively, the upper ends of which pass around and engage each other by means of curved portions 29 and 29'. An angular member 30 extends laterally and upwardly from the curved portion 29 in substantially the same plane as the angular portion 28 but in the opposite direction. In a similar manner, an angular member 30' extends laterally and upwardly from the curved portion 29' in the opposite direction from the angled portion 28'. The outer ends of the angular members 30 and 30' carry forwardly projecting horizontal arms 31 and 31', respectively, disposed above and in substantially the same plane as the inverted U-shaped connecting elements 23 and 23'. It will be readily understood that the bookrack of FIG. 4 is adapted to receive and hold books in the same manner as the first embodiment; that is, between the connecting elements 23 and 23' and between the arms 31 and 31'.

Figure 5:
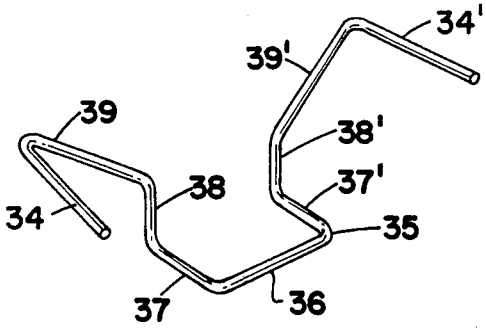
FIG. 5 is a perspective view of a third embodiment of the bookrack of this invention.

In the embodiment of FIG. 5, the bookrack base 35 comprises a front bar 36 and a pair of rearwardly projecting, parallel side bars 37 and 37'. Vertical elements 38 and 38' project upwardly from the rearwardly projected end portions of the side bars 37 and 37', respectively, the upper ends of which carry laterally outwardly and upwardly directed angle members 39 and 39'. The outer ends of the angled members 39 and 39' carry forwardly projecting, parallel arms 34 and 34', respectively. In this form of the invention, books are simply disposed between the parallel arms with a portion of the row of books resting on the base 35.

The form of the bookrack in FIG. 5 provides a particularly simplified retainer means for shelving a specific set or number of books which substantially fill the space horizontally between the arms 34 and 34'.

Figure 6:
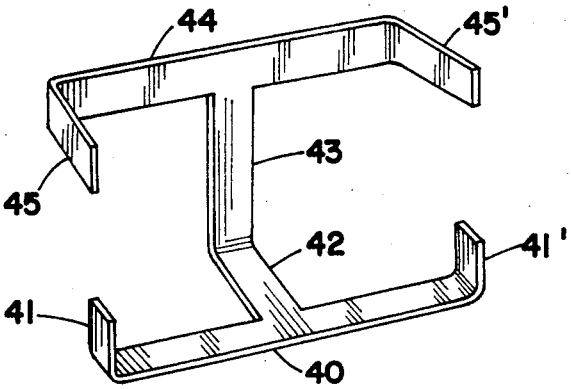
FIG. 6 is a perspective view of a fourth embodiment of the bookrack of this invention.

The final embodiment of the invention as disclosed in FIG. 6 is also of the open frame construction and is adapted to be formed from a single piece of sheet material, in this case a flat, relatively heavy gauge plastic which is cut and bent to the shape illustrated. In this way a bookrack is constructed of narrow, strip shaped elements which, as herein illustrated, are of uniform cross section. The bookrack comprises a flat, horizontal base 40 in the form of a straight, narrow strip having right angularly upwardly directed end stops 41 and 41'. A rearwardly projecting, horizontal leg 42 projects rearwardly from the middle of the base 40 and provides stability for the base. The rearwardly directed end of the leg 42 carries an upwardly directed vertical support 43 the upper end of which carries a laterally projecting, flat back member 44. Horizontal, parallel arms 45 and 45' project forwardly from the laterally directed ends of the back member above and substantially in the same plane as the end stops 41 and 41', respectively. Each bend is right angular whereby the plane of the sheet material from which the bookrack is formed lies in the plane of the part formed. Thus the forwardly projecting arms 45 and 45' and the upwardly projecting end stops 41 and 41' are disposed in vertical planes at right angles to the back member 44 and the base 40, respectively. At the same time, the base 40 and the back member 44 are also disposed in planes at right angles to each other.

It will be obvious that the bookrack of FIG. 6 is adapted to retain books between the forwardly projecting arms 45 and 45' and the end stops 41 and 41' with lower edge portions of a row of books resting upon the base 40 and with the back member 44 serving as a backstop for the books.

All of the embodiments of the invention as herein disclosed are characterized by an open frame construction wherein the bookrack itself occupies only a minimal space. This adapts the bookracks of this invention for storing the maximum number of books in a given space if desired. The different embodiments of the invention are also characterized by their adaptation to being constructed from a single piece of material and particularly adapted for providing customized book retaining means adapted to fit a particular set of books as well as for general purpose use with miscellaneous books. The bookrack of this invention is equally adapted for use in the library, home, or for display purposes in a bookstore or window.

In the foregoing specification and the following claims, the term "row of books" means a plurality of books disposed side-by-side on one edge in the normal manner of placing books on a bookshelf.

Although I have described preferred embodiments of my invention, obvious changes may be made which are still within the spirit of the invention and the scope of the following claims.

I claim:

1. A bookrack of open framework construction, said bookrack comprising:

a horizontal base including a laterally extending first bar for supporting the bottoms of books, and a pair of laterally coaxial base bars parallel with and disposed rearwardly from said first bar;

a pair of laterally spaced, vertically extending connecting elements connecting said base bars and said first bar, said connecting elements providing lateral support to the lower side portions of books in the bookrack; and, a vertical back extending upwardly from a rearward portion of said base, said back including at least one upwardly extending back bar connected to the rearward portion of said base and having arm means connected at one end to said upwardly extending back bar and terminating in forwardly extending end means, said arm means providing lateral support to books in the bookrack.

2. The invention according to claim 1 wherein connecting elements comprise inverted U-shaped elements interconnecting opposing ends of said front bar and the respective coaxial base bars.

3. The invention according to claim 1 wherein said at least one rearward base bar comprises a pair of laterally spaced spacer bars transverse to and extending rearwardly from said first bar, said upwardly extending back bars being connected to the respective spacer bars.

4. The invention according to claim 1 wherein said base and said back comprise a unitary element made of heavy wire.

5. The invention according to claim 1 wherein said base and said back are made of flat strip.

6. The invention according to claim 1 wherein said first bar comprises a flat, forwardly disposed strip, said rearward base bar comprises a flat strip extending rearwardly and transversely from said first bar, said upwardly extending back bar comprises a flat, vertical strip extending upwardly from said rearward base bar, said last mentioned vertical strip having a flat horizontal strip attached at its midsection to the upper portion of said vertical strip and having opposite lateral end portions, and said arms comprising flat strips extending forwardly from the respective end portions of said horizontal strip.

7. A bookrack of open framework construction, said bookrack comprising:

a horizontal base including a laterally extending first bar for supporting the bottoms of books;

a vertical back extending upwardly from a rearward portion of said base, said back including a pair of vertical, parallel bars extending upwardly from said base, and angular, diverting members extending upwardly and outwardly from the respective vertical, parallel bars, and arms extending forwardly from the respective angular members for providing lateral support to books in the bookrack.

8. A bookrack of open framework construction, said bookrack comprising:

a horizontal base including a laterally extending first bar for supporting the bottoms of books;

a vertical back extending upwardly from a rearward portion of said base, said back including a pair of laterally spaced lower angled portions connected to the base, intermediate portions extending from the respective angled portions and inclined towards each other, and curved portions extending from the respective intermediate portions and passing around each other, and angular, diverging members extending upwardly and outwardly from the respective curved portions, and arms extending forwardly from the respective angular members.

* * * * *